US009051698B1

(12) United States Patent
Anghileri et al.

(10) Patent No.: US 9,051,698 B1
(45) Date of Patent: Jun. 9, 2015

(54) CRASH ATTENUATOR APPARATUS

(71) Applicant: LINDSAY TRANSPORTATION SOLUTIONS, INC., Omaha, NE (US)

(72) Inventors: Marco Anghileri, Milan (IT); Valeria Di Giacomo, Bergamo (IT); Silvio Mazzola, Milan (IT)

(73) Assignee: Lindsay Transporation Solutions, Inc., Omaha, NE (US)

( * ) Notice: Subject to any disclaimer, the term of this patent is extended or adjusted under 35 U.S.C. 154(b) by 0 days.

(21) Appl. No.: 14/308,941

(22) Filed: Jun. 19, 2014

(51) Int. Cl.
*E01F 15/14* (2006.01)
*E01F 15/04* (2006.01)

(52) U.S. Cl.
CPC ..... *E01F 15/0423* (2013.01); *E01F 15/0461* (2013.01); *E01F 15/146* (2013.01)

(58) Field of Classification Search
CPC ..... C08G 18/3215; C08G 18/4854; E01F 15/146; E01F 15/0423; E01F 15/0461
USPC ..... 404/6, 9, 10; 256/13.1
See application file for complete search history.

(56) References Cited

U.S. PATENT DOCUMENTS

| | | | | | |
|---|---|---|---|---|---|
| 4,321,989 | A * | 3/1982 | Meinzer | 188/377 |
| 4,399,980 | A * | 8/1983 | van Schie | 256/13.1 |
| 4,407,484 | A * | 10/1983 | Meinzer | 256/13.1 |
| 5,391,016 | A * | 2/1995 | Ivey et al. | 404/6 |
| 5,733,062 | A * | 3/1998 | Oberth et al. | 404/6 |
| 5,851,005 | A | 12/1998 | Muller et al. | |
| 6,293,727 | B1 * | 9/2001 | Albritton | 404/6 |
| 6,457,570 | B2 * | 10/2002 | Reid et al. | 188/377 |
| 6,461,076 | B1 * | 10/2002 | Stephens et al. | 404/6 |
| 6,811,144 | B2 | 11/2004 | Denman et al. | |
| 7,306,397 | B2 * | 12/2007 | Albritton | 404/6 |
| 7,396,184 | B2 * | 7/2008 | La Turner et al. | 404/6 |

* cited by examiner

*Primary Examiner* — Raymond W Addie
(74) *Attorney, Agent, or Firm* — Thomas R. Lampe

(57) ABSTRACT

Apparatus for absorbing energy when impacted by a vehicle includes a backstop structure, a track extending to the backstop structure, a plurality of collapsible tubes supported by spaced independently movable supports on the track, and stabilizer structure stabilizing the supports in three planes during movement of the supports on the track and collapse of the tubes.

13 Claims, 8 Drawing Sheets

CRASH ATTENUATOR APPARATUS

TECHNICAL FIELD

This invention relates to apparatus for absorbing energy when impacted by a vehicle. More specifically, the apparatus is used as a barrier which dissipates the energy of moving vehicles upon impact with an end of the apparatus.

BACKGROUND OF THE INVENTION

It is well known to provide impact absorbing systems, often called "crash cushions" or "crash attenuators", adjacent to rigid structures such as pillars, bridge abutments, lighting poles and the like for the purpose of absorbing vehicle impact energy and minimizing the effects of impact on the vehicle, the vehicle occupants and the structure being protected.

There are many forms and types of energy absorption barriers.

U.S. Pat. No. 5,851,005, issued Dec. 22, 1998, discloses an energy absorption barrier assembly including multiple pairs of ground engaging support uprights interconnected to one another by overlapping side panels. The side panels and uprights are connected together by inter-engaging slides so that an impact at the end of the barrier assembly can cause relative movement between the uprights, between the side panels, and between the uprights and the side panels. Located between the uprights and secured thereto are a plurality of energy absorbing metal plates configured in such a way that they collapse in a controlled manner upon vehicle impact to absorb impact forces.

U.S. Pat. No. 6,811,144, issued Nov. 2, 2004, discloses apparatus for absorbing energy when impacted by a vehicle that includes relatively movable vertical, spaced supports supporting modules extending between the supports. The modules are collapsing containers defining a pressurizable interior. The modules include two module segments, the side wall of the module forming a truncated cone at each of the module segments.

Cables extend between front and rear anchor structures of the apparatus and pass through cable passageways in the supports sized to allow relative slidable rotation between the cables and the guide members upon application of suitable forces caused by head on vehicle impact.

The supports are in the form of steel support frames extending upwardly from the ground.

It is also known to utilize elongated members such as metal tubes positioned between relatively movable supports which collapse when endwise forces are applied to the apparatus upon vehicle impact. Typically, however, in such arrangements the positioning of the tubes and the movable supports engaging the tube ends are stabilized in only one plane. Eccentric loading thus becomes a problem and the tubes between adjacent supports are not subjected to even compression by the relatively movable supports. This results in uneven collapse of the tubes, causing stability and crash control problems, even failure of the system.

DISCLOSURE OF INVENTION

With the apparatus disclosed herein relatively movable supports engaging tube ends are stabilized in three planes, all three vectors stabilized to minimize eccentric loading. This results in the tubes between adjacent supports collapsing substantially uniformly about the longitudinal axes of the tubes when compressed between adjacent supports.

The apparatus is for absorbing energy when impacted by a vehicle and includes a backstop structure affixed to the ground and extending upwardly therefrom.

An elongated track extends along the ground toward the backstop structure.

A plurality of supports are mounted for independent movement along the track and extend upwardly from the track. The supports are spaced from one another and spaced from the backstop structure.

A plurality of elongated, collapsible, hollow metal tubes are supported by and extend between adjacent supports with opposed ends of the tubes abutting the adjacent supports. The tubes have longitudinal axes extending parallel to one another and parallel to the track.

According to the invention, stabilizer structure is operatively associated with the track and with the supports stabilizing the supports in three planes to prevent tilting of the supports when the supports move along the track toward the backstop due to impact between the apparatus and a vehicle, whereby each of the collapsing tubes between adjacent supports will collapse substantially uniformly about the longitudinal axes thereof when compressed between said adjacent supports.

Other features, advantages and objects of the present invention will become apparent with reference to the following description and accompanying drawings.

MODES FOR CARRYING OUT THE INVENTION

Figures 1, 2, 3:
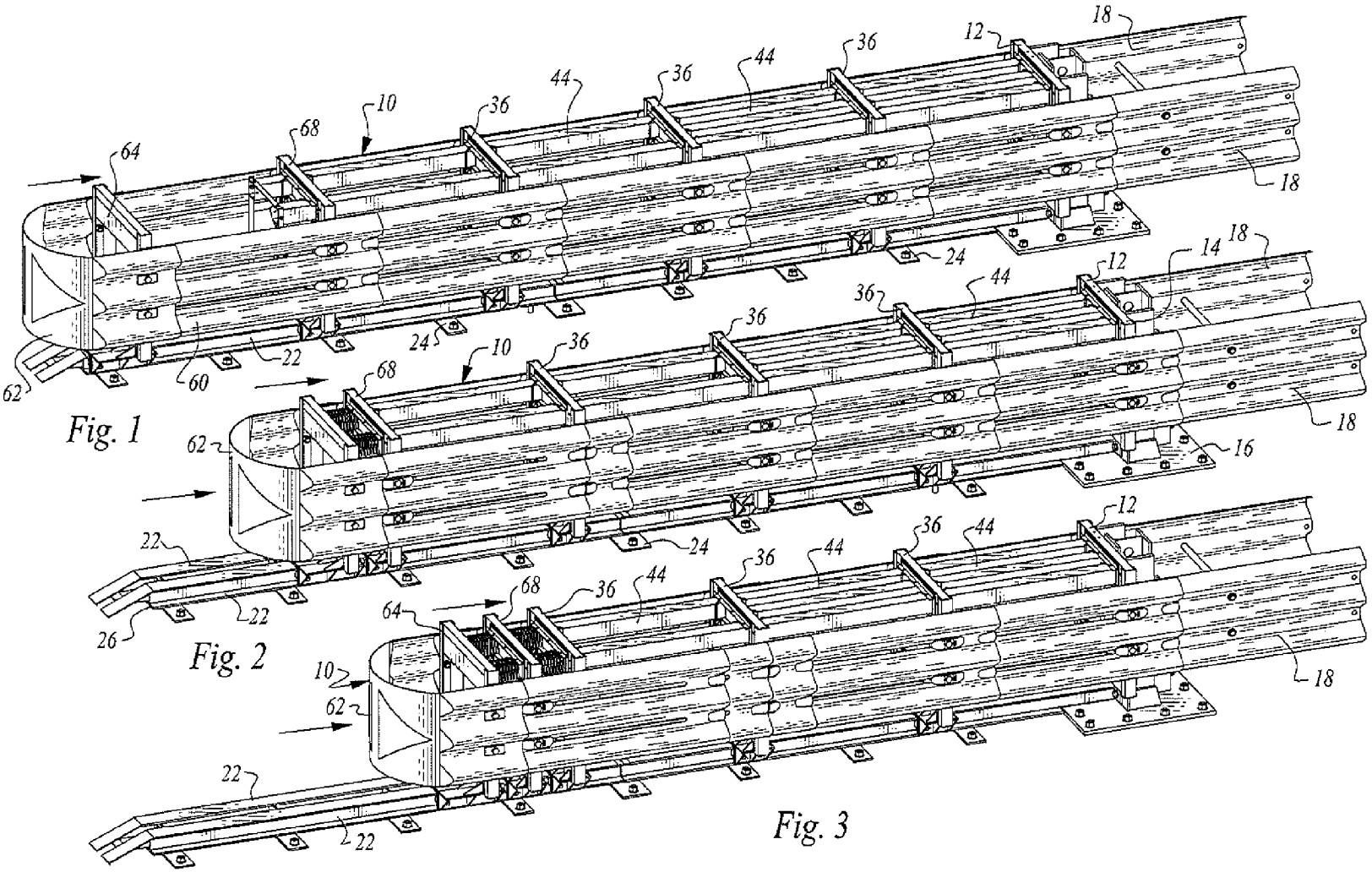
FIGS. 1-6 are perspective views illustrating apparatus constructed in accordance with the teachings of the present invention in sequential conditions or stages assumed thereby after head-on impact by a vehicle (not shown) on the nose piece of the apparatus.
Figures 4, 5, 6:
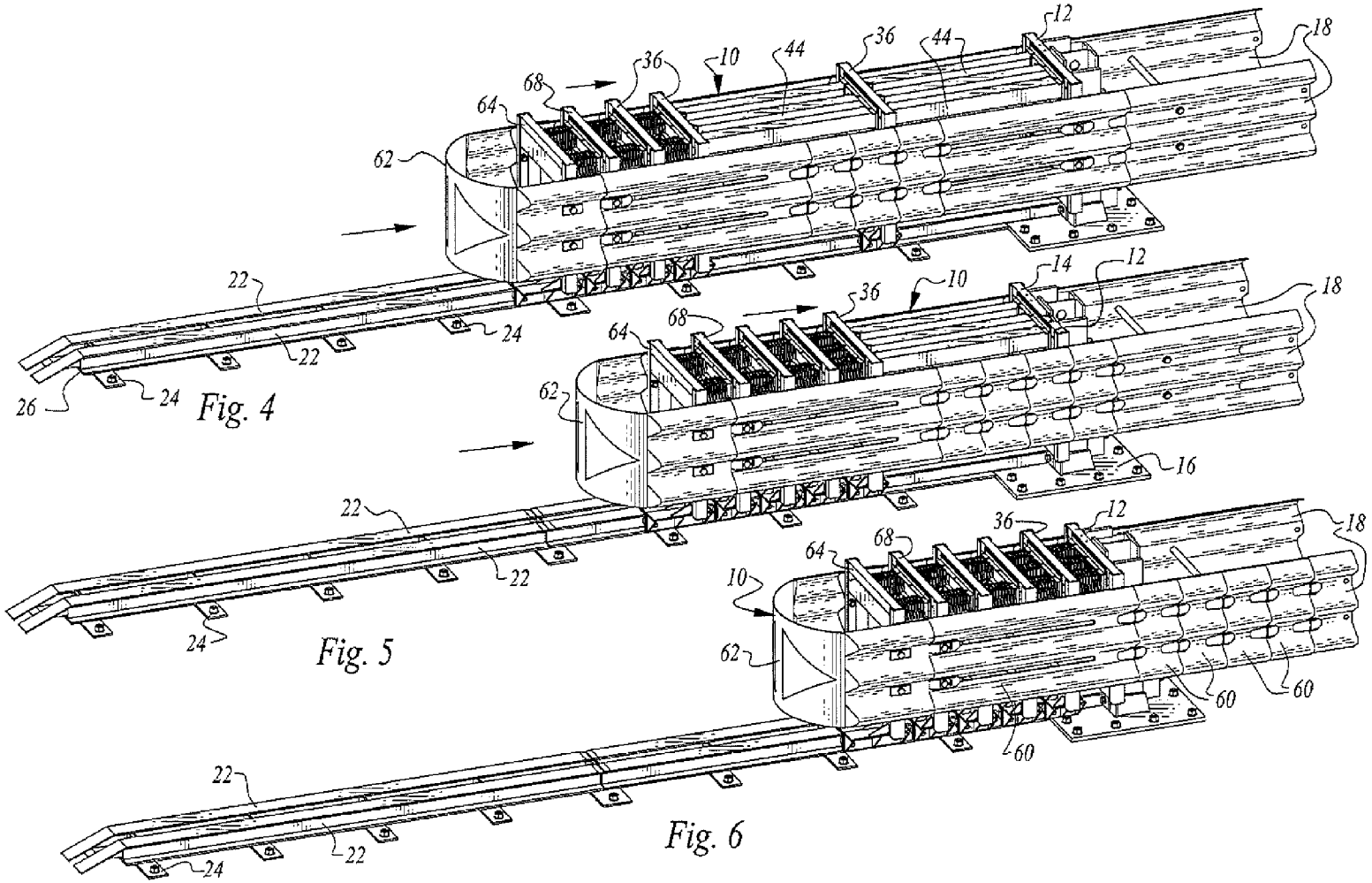
Figure 7:
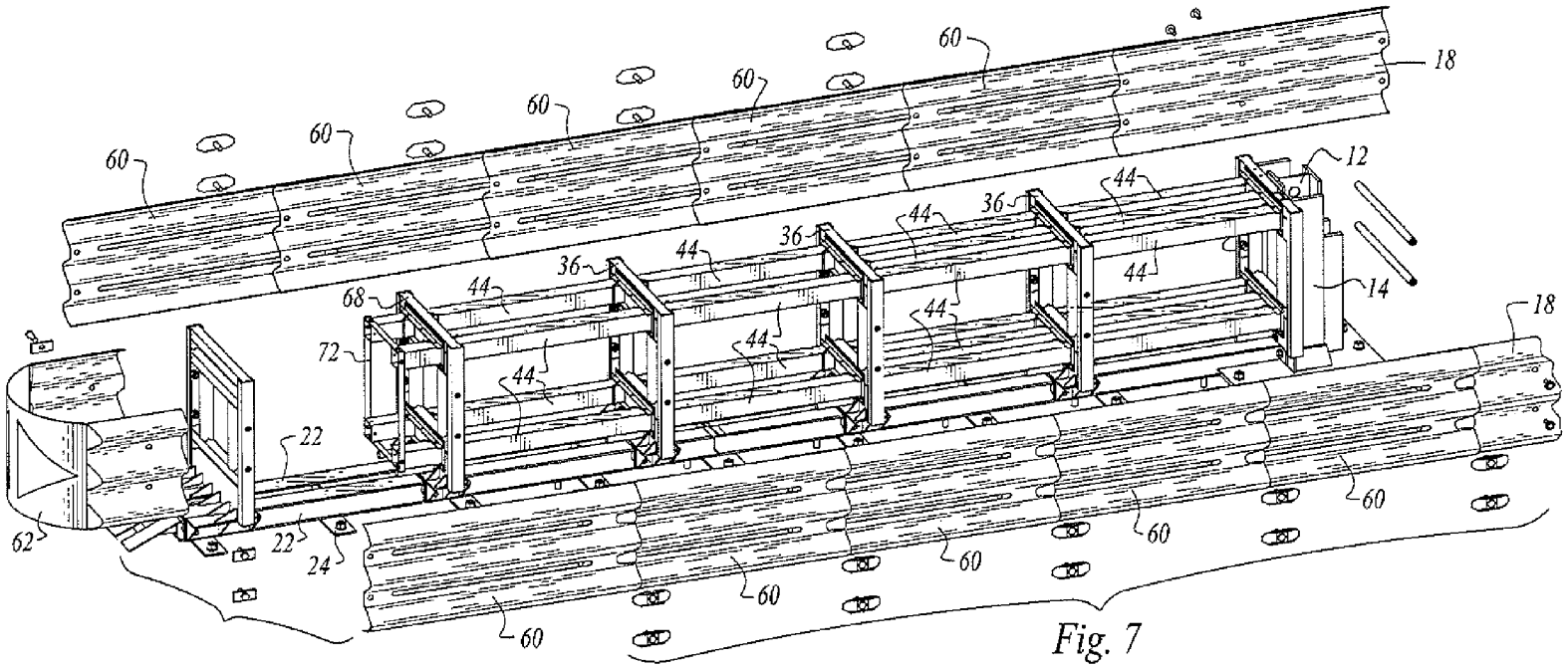
FIG. 7 is an exploded, perspective view illustrating structural components of the apparatus prior to complete assembly of the apparatus.
Figure 8:
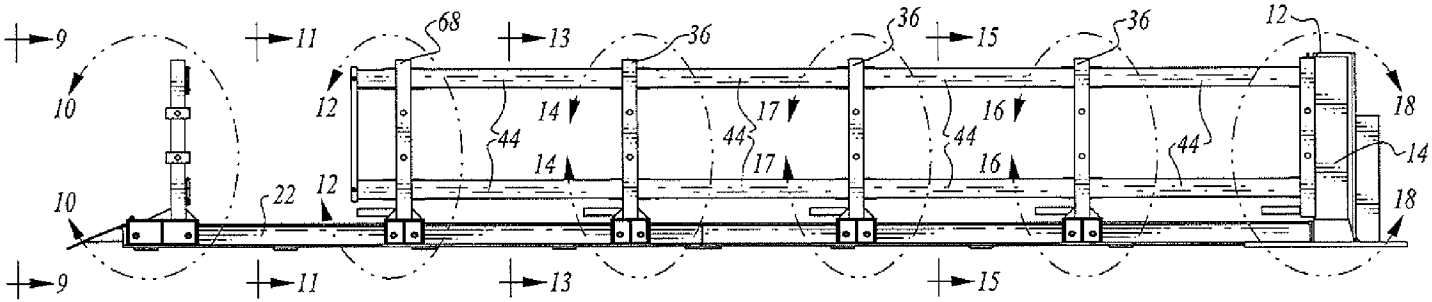
FIG. 8 is a somewhat diagrammatic, side elevational view illustrating selected structural components of the apparatus, the overlapping side panels and nose piece of the apparatus not being illustrated.
Figure 9:
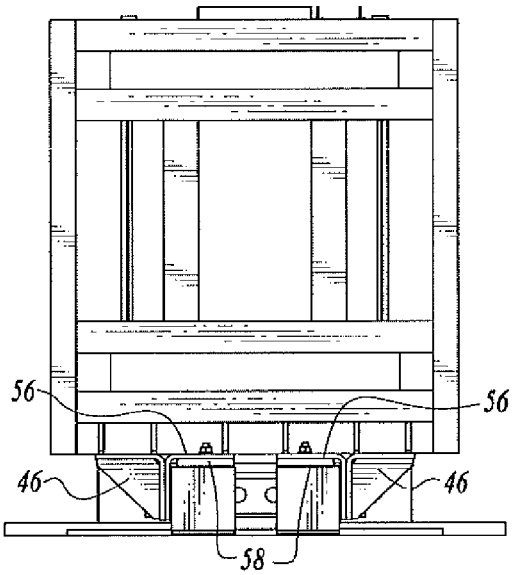
FIG. 9 is an enlarged, frontal elevational view taken in the direction of arrows 9-9 in FIG. 8.
Figure 10:
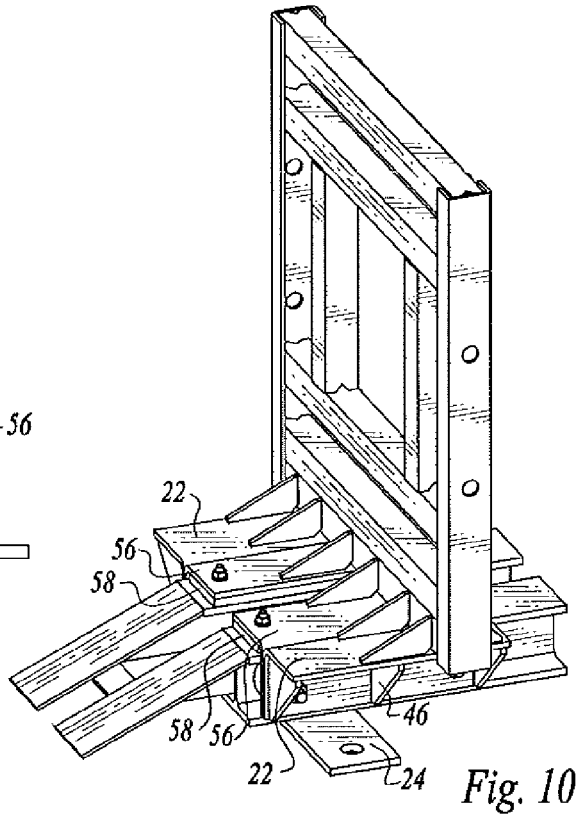
FIG. 10 is an enlarged, perspective view of a nosepiece framework of the apparatus located at the distal end of the track rails of the apparatus and encompassed by double headed arrow dash line 10-10 in FIG. 8.
Figure 11:
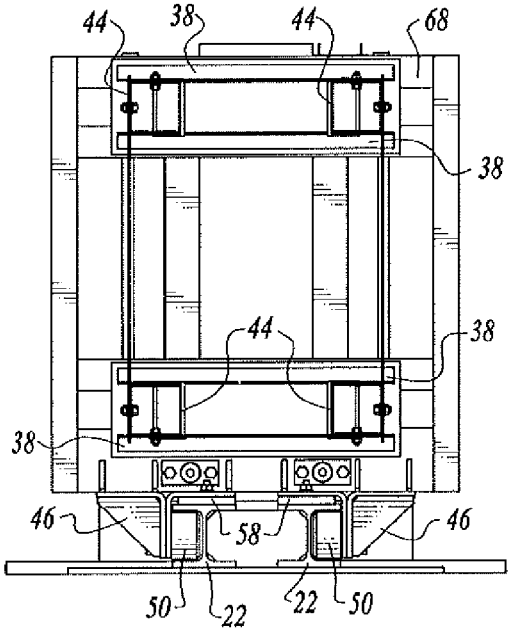
FIG. 11 is an enlarged, frontal elevational view taken in the direction of arrows 11-11 in FIG. 8.
Figure 12:
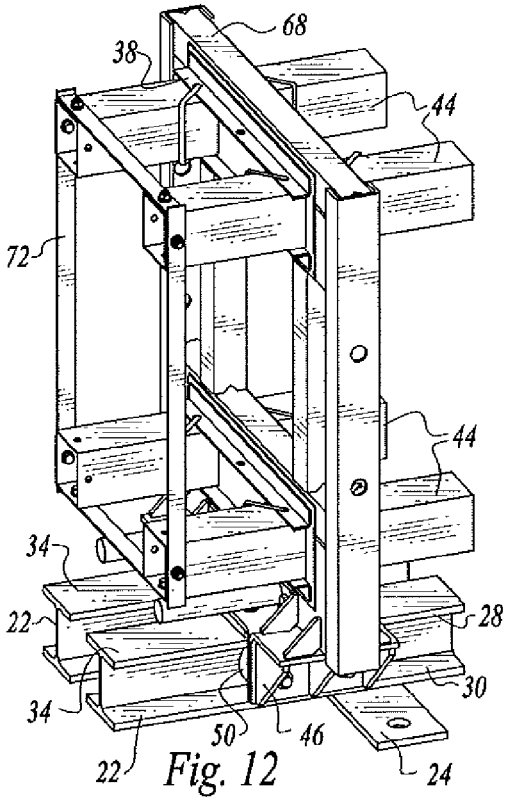
FIG. 12 is an enlarged, perspective view of structure encompassed by double headed arrow dash line 12-12 in FIG. 8.
Figure 14:
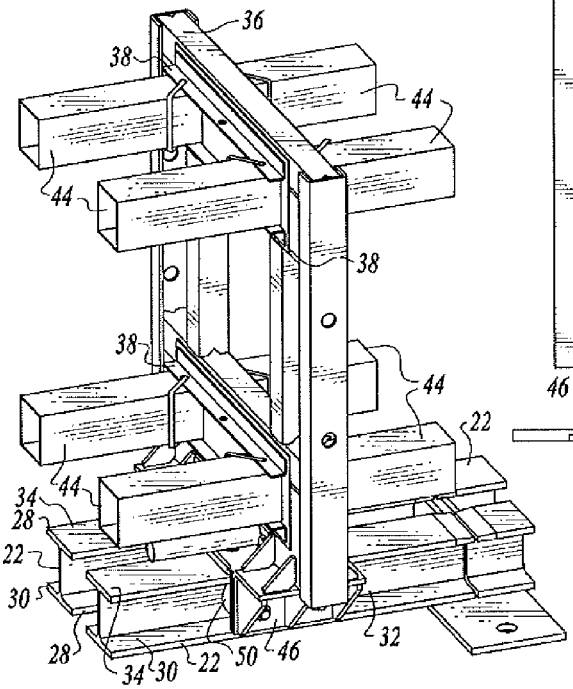
FIG. 14 is an enlarged, perspective view of structure encompassed by double headed arrow dash line 14-14 in FIG. 8.
Figure 13:
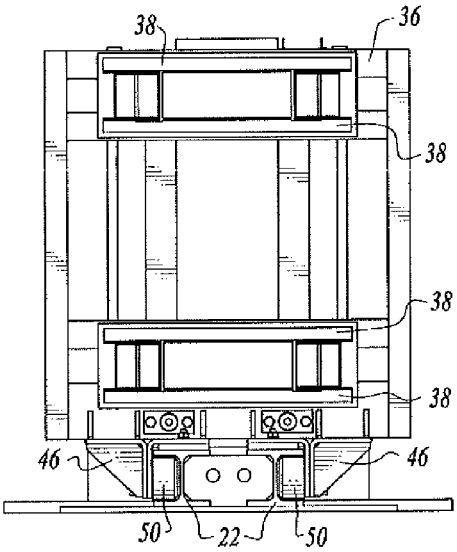
FIG. 13 is an enlarged, frontal elevational view taken in the direction of arrows 13-13 in FIG. 8.
Figure 15:
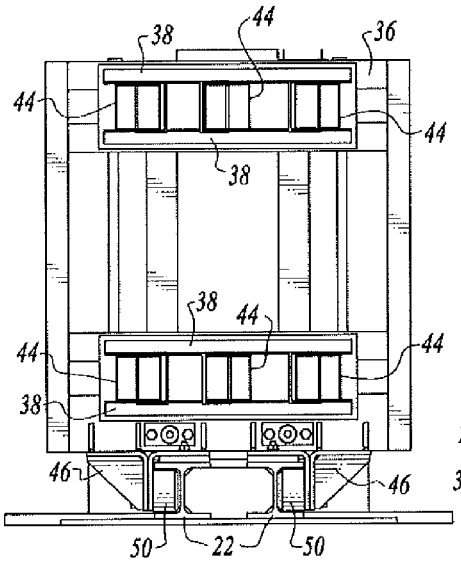
FIG. 15 is an enlarged, frontal elevational view taken in the direction of arrows 15-15 in FIG. 8.
Figure 16:
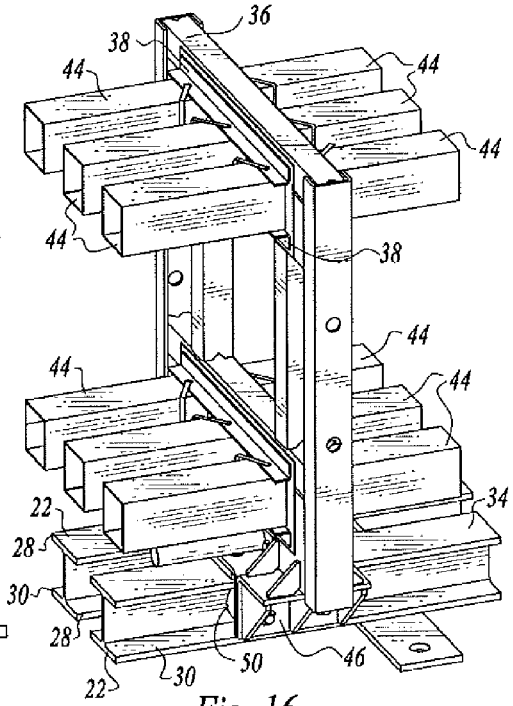
FIG. 16 is an enlarged, perspective view of structure encompassed by double headed arrow dash line 16-16 in FIG. 8.
Figure 18:
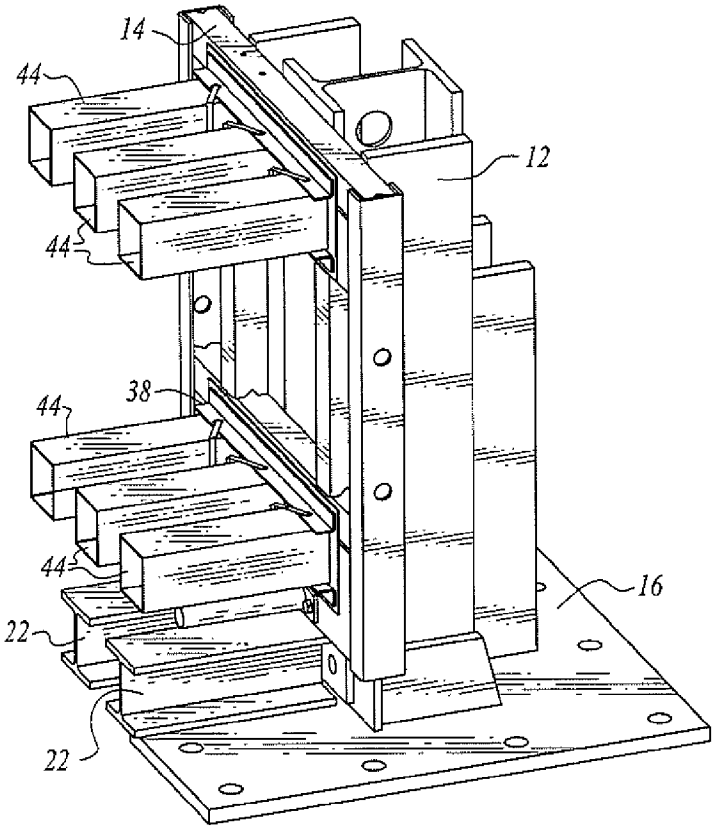
FIG. 18 is an enlarged, perspective view of the backup structure encompassed by double headed arrow dash line 18-18 in FIG. 8.
Figure 17:
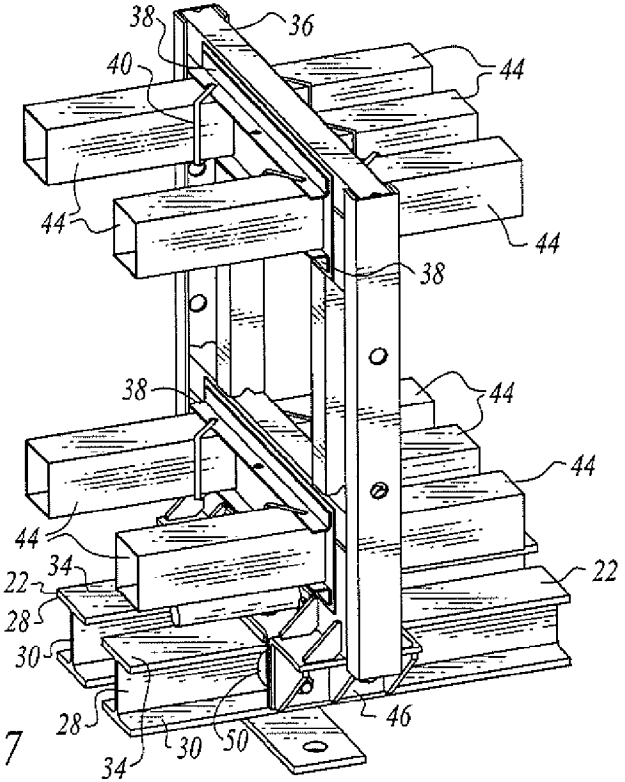
FIG. 17 is an enlarged, perspective view of the structure encompassed by double headed arrow dash line 17-17 in FIG. 8.

FIGS. 1-21 illustrate apparatus 10 constructed in accordance with the teachings of the present invention. The apparatus 10 is for absorbing energy when impacted by a vehicle. More specifically, the apparatus is utilized as a barrier which dissipates the energy of moving vehicles upon impact with an end of the apparatus.

Apparatus 10 includes a rigid backup structure 12 which is anchored to the ground. In the arrangement illustrated, the backup structure includes a backup structure frame 14 which extends upwardly from a base 16 fixedly secured to the ground by any suitable expedient such as anchor bolts.

In the disclosed embodiment, the backup structure frame 14 has side panels 18 secured thereto. The backup structure 12 may be located in front of a structure (not shown) to be protected thereby, such structure being, for example, pillars, bridge abutments, lighting poles, traffic side rails or dividers.

An elongated track including two parallel rails 22 extends along the ground toward the backup structure. The rails 22 are I beams secured to the ground by any suitable desired expedient, such as rail support hold down plates 24 at spaced locations along the rails. The track has a distal track end 26. Outer flanges of the I beam rails 22 function as upper and lower elongated guides 28 and 30, respectively, which define longitudinal channels 32. The top surfaces 34 of the rails serve a function to be described below.

A plurality of supports 36 are mounted for independent movement along the track and extend upwardly from the track, the supports being spaced from one another and spaced from the backstop structure 12.

The supports 36 include rigid frameworks and additionally include support brackets 38 on the frameworks. The support brackets 38 are for receiving and supporting the tube ends of elongated, collapsible, hollow metal tubes 44 extending between adjacent supports with the opposed tube ends abutting the adjacent supports. The tubes 44 have longitudinal axes extending parallel to one another and parallel to the track comprising rails 22.

In the arrangement illustrated, the tubes 44 have four sides and have a square cross-sectional configuration. The tubes are suitably formed of aluminum. In the illustrated embodiment four tubes are positioned between adjacent support frameworks at the portion of the apparatus furthest from the back structure 12 and six tubes 44 are located between adjacent supports in the portion of the apparatus closest to the backup structure. Removable pins 40 pass through associated upper and lower brackets 38 to maintain the tubes in place on the brackets.

Attached to the rigid frameworks of the supports 36 and extending downwardly therefrom are wheel mounts 46 holding wheels 50. The wheels are positioned on and supported by the lower outwardly extending flanges 30 of the rails 22 and extend into the longitudinal channels between the upper and lower outwardly extending flanges 28, 30 of the rails. In the arrangement illustrated, there are two wheels 50 on each wheel mount 46, the wheels being spaced from one another.

The wheel mounts 46 also include inwardly extending mount portions 56 to which plates 58 formed of low friction material, such as polyoxymethylene (POM) or polytetrafluoroethylene (PTFE), engageable with the upper surfaces 34 of the I beam rails 22.

The structural elements described above in the immediately foregoing paragraphs function as stabilizer structure operatively associated with the track and with the supports stabilizing the supports in three planes to prevent tilting of the supports when the supports move along the track toward the backstop structure 12 due to vehicle impact on the distal end of the apparatus whereby the collapsing tubes 44 between adjacent supports 36 will collapse substantially uniformly about the longitudinal axes thereof when compressed between the adjacent supports.

FIG. 1 shows the condition of the apparatus prior to impact. FIG. 2 shows the initial stage of collapse due to impact of an automobile or other vehicle with the apparatus on a nose assembly of the apparatus, the nose assembly including a nose piece 62 attached to nose piece frame 64 connected to rails 22 by wheels and wheel mounts in the manner described above with respect to supports 36. Depending upon the impact force, subsequent stages of collapse will take place as illustrated in FIGS. 3-6, with sequential collapsing of sets of tubes 44 taking place.

Figure 19:
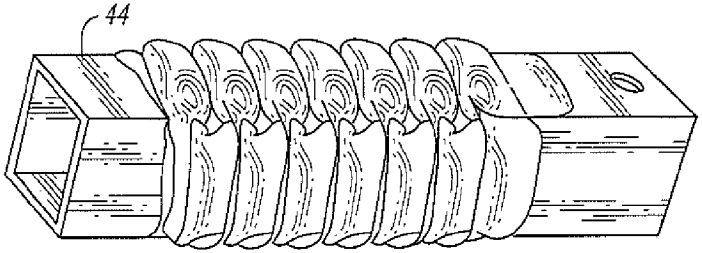
FIG. 19 is an enlarged, perspective view of a collapsed tube.
Figure 20:
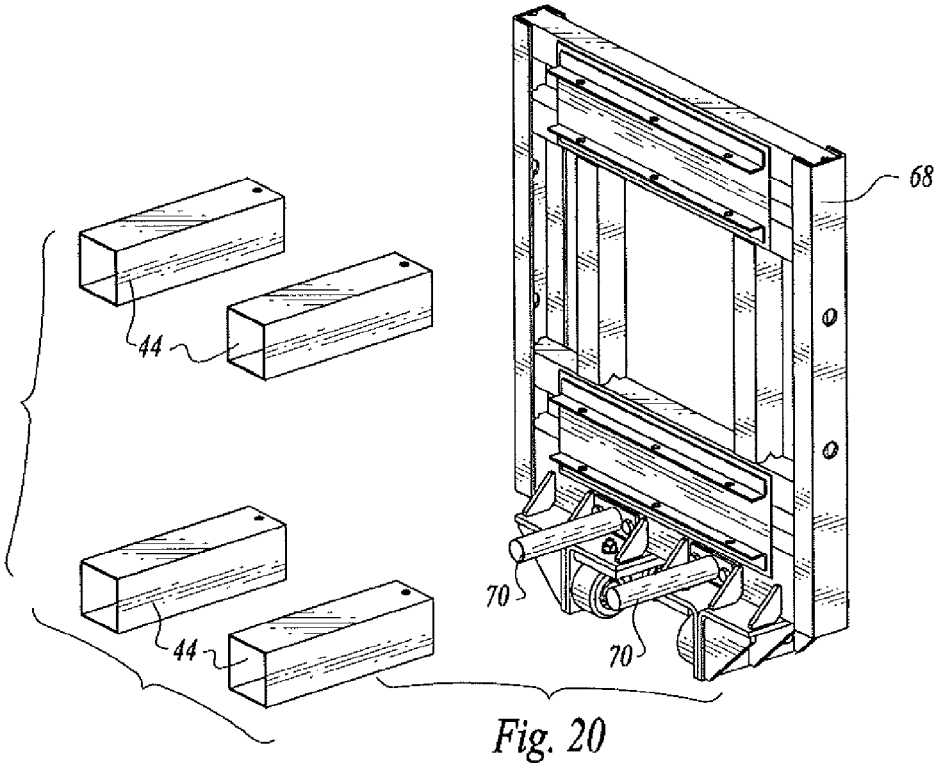
FIG. 20 is an exploded, perspective view of an endmost support and short tubes.
Figure 21:
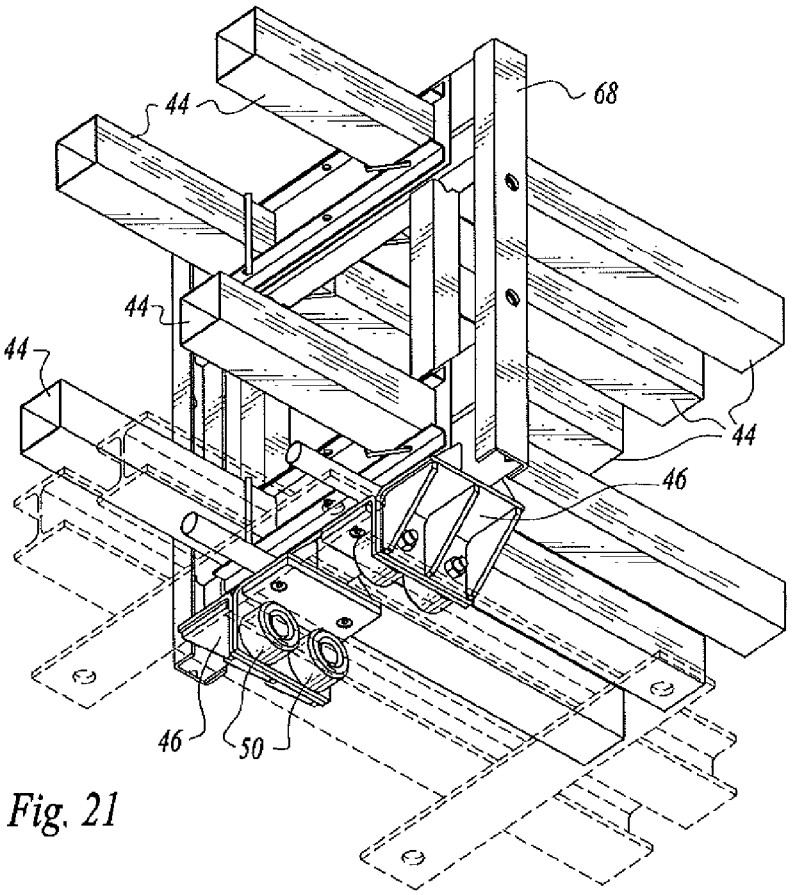
FIG. 21 is a bottom, perspective view of the endmost support with attached tubes.
Figure 23:
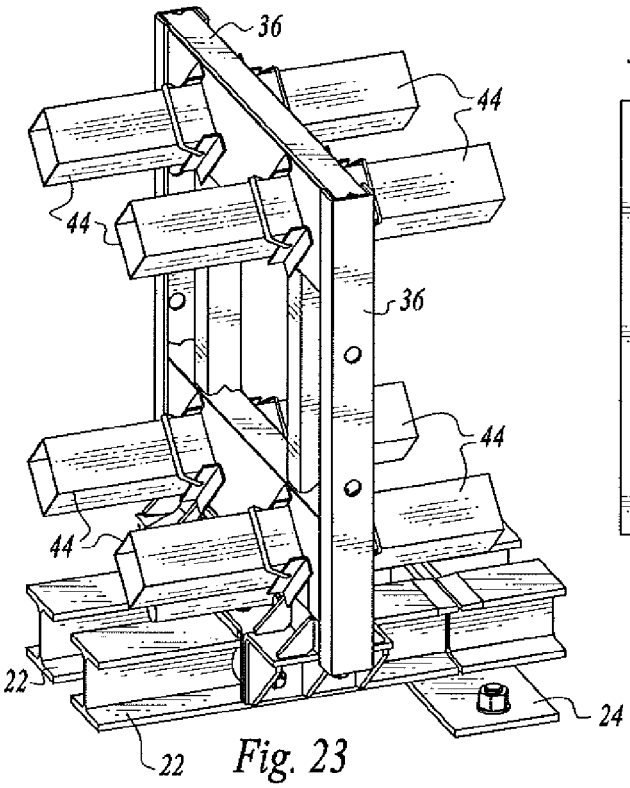
FIG. 23 is a perspective view of the second embodiment.
Figure 22:
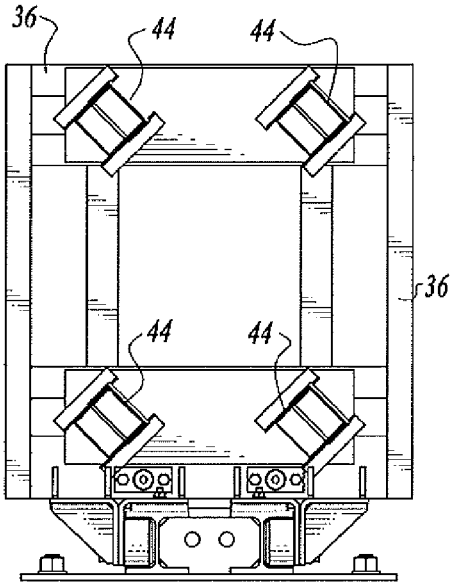
FIG. 22 is an elevational view of a second embodiment of tube support.
Figure 25:
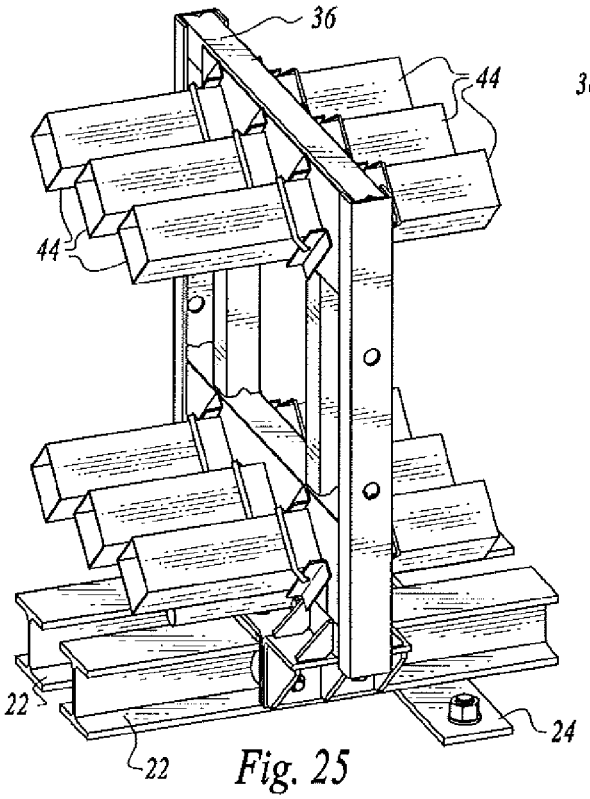
FIG. 25 is a perspective view of the third embodiment.
Figure 24:
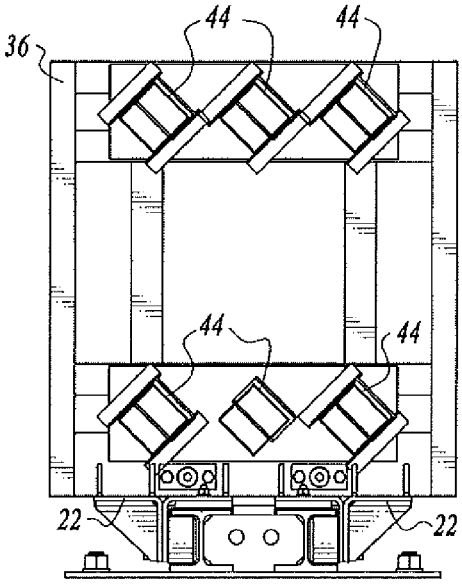
FIG. 24 is an elevational view of a third embodiment of tube support.

FIG. 19 shows the condition of a tube 44 in collapsed condition. It will be noted that the tube illustrated in FIG. 19 is collapsed substantially uniformly about the longitudinal axis thereof when compressed between the adjacent supports associated therewith.

More particularly, with respect to the stabilizer structure of the invention and operation of the components thereof, the rails and wheel mount supported wheels along with the friction plate structure prevent tilting of the supports backward or forward, sideways or about a vertical pivot axis. That is, the support is held stable relative to X, Y and Z axes.

In the arrangement illustrated, overlapping side panels 60 are connected to the supports and telescope responsive to movement of the supports along the track toward the backstop structure 12. The use of overlapping side panels connected to supports in crash attenuators is known, but not in combination with the stabilizing structure of this invention described above.

The nose assembly is located at the end of the apparatus most remote from the backstop structure and, as indicated above, the nose assembly is also mounted on the track and movable therealong when impacted by a vehicle. FIG. 1 shows the nose assembly at the initial location thereof. Upon impact the nose assembly will move toward the backup structure as indicated by the arrow and nose piece frame 64 will impact an endmost support 68 supporting short length tubes 44. Support 68 supports both ends of the short tubes projecting toward the nose assembly. Support 68 also support one end of regular size tubes extending in the direction of the backup structure. The distal ends of the short tubes are connected together by a sub frame 72. Upon impact with the endmost support by the nose assembly the short tubes of the end-most support 68 will be the first to collapse.

The endmost support and the backup structure 12 include shock absorbers 70. Shock absorbers may also be used on the supports 36.

FIGS. 22-25 show alternative embodiments of the invention wherein tubes 44 are supported with all four sides thereof disposed at substantially 45 degrees relative to horizontal and vertical as compared to the first embodiment wherein two sides of the tubes are disposed vertically and two sides thereof are disposed horizontally.

The invention claimed is:

1. Apparatus for absorbing energy when impacted by a vehicle, said apparatus comprising, in combination:

a backstop structure affixed to the ground and extending upwardly therefrom;

an elongated track extending along the ground toward said backstop structure, said track including two parallel rails spaced from one another, each of said rails having channel defining structure defining an elongated channel, said elongated channels spaced from one another;

a plurality of supports including tube support structure mounted for independent movement along said track and extending upwardly from said track, said supports being spaced from one another along said track and spaced from said backstop structure, said supports disposed at right angles relative to the direction of movement of said supports along said track;

a plurality of elongated, collapsible, hollow metal tubes supported by said tube support structure in fixed position relative to said supports and extending between adjacent supports with opposed ends of said tubes abutting said adjacent supports, said tubes having longitudinal axes extending parallel to one another, parallel to said track and disposed at right angles to said supports; and stabilizer structure including the channel defining structure of said rails operatively associated with said supports stabilizing said supports to prevent tilting of said supports backward or forward, sideways or about a vertical pivot axis whereby said tubes are maintained at right angles to said supports when said supports move along the track toward said backstop due to impact between the apparatus and a vehicle, and whereby each of the collapsing tubes between adjacent supports will collapse substantially uniformly about the longitudinal axis thereof when compressed between said adjacent supports, said channel defining structure including spaced upper and lower elongated guides and said supports including rigid frameworks, said stabilizer structure further including wheels attached to said frameworks and supporting said frameworks positioned in said longitudinal channels between said upper and lower elongated guides.

2. The apparatus according to claim 1 wherein said supports include wheel mounts attached to said frameworks and wherein said wheels are rotatably mounted on said wheel mounts and positioned on and supported by said lower elongated guides, at least two wheels on each wheel mount, with one wheel disposed behind the other wheel.

3. The apparatus according to claim 1 wherein said stabilizer structure additionally includes low friction plates attached to said frameworks and engageable with upper rail surfaces of said rails adjacent to said channels.

4. The apparatus according to claim 1 wherein said tubes have four sides and have a square cross-sectional configuration.

5. The apparatus according to claim 4 wherein said tubes are supported with two sides thereof disposed vertically and two sides thereof disposed horizontally.

6. The apparatus according to claim 4 wherein said tubes are supported with all four sides thereof disposed at substantially 45 degrees relative to horizontal and vertical.

7. The apparatus according to claim 1 additionally comprising a nose assembly spaced from the support most remote from said backstop structure and responsive to vehicle impact on said nose assembly to move toward the backstop structure.

8. The apparatus according to claim 1 wherein said track is attached to said backstop structure.

9. The apparatus according to claim 1 additionally including overlapping side panels connected to said supports and telescoping responsive to movement of said supports along the track toward said backstop structure.

10. The apparatus according to claim 1 additionally including shock absorber structure at said backstop structure.

11. The apparatus according to claim 7 wherein said support most remote from said backstop structure includes tube support structure supporting tubes with distal tube ends thereof spaced from said nose assembly before vehicle impact on said nose assembly.

12. The apparatus according to claim 1 wherein said rails are I beams.

13. The apparatus according to claim 1 wherein the elongated channels of said rails face inwardly toward one another.

* * * * *